US005677519A

United States Patent [19]

Herkel et al.

[11] Patent Number: 5,677,519

[45] Date of Patent: Oct. 14, 1997

[54] ELEVATOR LEVELING ADJUSTMENT

[75] Inventors: Peter Herkel; Christoph Ernecke; Mustapha Toutaoui; Alberto Vecchiotti, all of Berlin, Germany

[73] Assignee: Otis Elevator Company, Farmington, Conn.

[21] Appl. No.: 610,101

[22] Filed: Feb. 29, 1996

[51] Int. Cl.[6] ..... B66B 1/40; B66B 1/34

[52] U.S. Cl. ..... 187/291; 187/283; 187/394

[58] Field of Search ..... 187/294, 295, 187/291, 283, 282, 394

[56] References Cited

U.S. PATENT DOCUMENTS

| | | | |
|---|---|---|---|
| 4,427,095 | 1/1984 | Payne et al. | 187/29 R |
| 4,499,974 | 2/1985 | Nguyen et al. | 187/29 R |
| 4,750,592 | 6/1988 | Watt | 187/134 |
| 4,798,267 | 1/1989 | Forster et al. | 187/28 |
| 4,991,693 | 2/1991 | Stern et al. | 187/111 |

FOREIGN PATENT DOCUMENTS

| | | |
|---|---|---|
| 0607646A1 | 1/1993 | European Pat. Off. . |
| 3173581 | 3/1991 | Japan . |

*Primary Examiner*—Robert Nappi

[57] ABSTRACT

A method of adjusting a leveling time of an elevator car is disclosed. The method includes the steps of: moving the elevator car in a hoistway; transmitting a first signal by a first sensor in response to moving the elevator car in the hoistway; beginning a time measurement in response to detecting the first signal; transmitting a second signal by a second sensor in response to moving the elevator car in the hoistway, the second sensor being disposed a predetermined distance from the first sensor; ending the time measurement in response to detecting the second signal; determining a time measurement value in response to ending the time measurement; determining a leveling speed of the elevator car by dividing the predetermined distance between the first sensor and the second sensor by the time measurement value; and adjusting the leveling time in response to determining the leveling speed.

14 Claims, 7 Drawing Sheets

ELEVATOR LEVELING ADJUSTMENT

TECHNICAL FIELD

The present invention relates generally to elevators and, in particular, relates to elevator leveling adjustment.

BACKGROUND OF THE INVENTION

Modem elevators systems utilize sophisticated software in controllers which control most aspects of the elevator's operation. The controllers gather information from various sources in the elevator system and use that information to efficiently operate the elevator. Thus, elevator speed, starting, stopping, dispatching, floor positioning or leveling, and the like are all governed by the controller. In performing its functions, a most important input for the controller soft-ware is the speed of the car. Speed information is especially useful in providing accurate stopping at the various landings in a building.

Elevators systems generally use a sensor to monitor to the shaft of the electric motor which drives the traction sheave on the elevator. The sensor of choice is an encoder which measures motor shaft revolutions and translates the results into machine readable signals delivered to the controller microprocessor. The encoder operates by having a rotatable encoder shaft connected to the motor shaft so as to rotate conjointly therewith. The number, direction, and speed of encoder shaft rotations thus indicate the direction of movement, speed and position of the elevator car. The encoder, however, introduces added expense and complexity into the elevator system. Additionally, the encoder must be configured to cooperate with a large number of different motor designs. Thus, the cost of modernizing a large variety of elevator systems is very high.

DISCLOSURE OF THE INVENTION

It is therefore an object of the present invention to provide a cost effective apparatus and method for determining leveling speed of an elevator.

It is another object of the present invention to provide a cost effective apparatus and method for adjusting a leveling time based upon the leveling speed of an elevator.

According to the present invention, a method of adjusting a leveling time of an elevator car, the method comprising the steps of: moving the elevator car in a hoistway; transmitting a first signal by a first sensor in response to moving the elevator car in the hoistway; beginning a time measurement in response to detecting the first signal; transmitting a second signal by a second sensor in response to moving the elevator car in the hoistway, the second sensor being disposed a predetermined distance from the first sensor; ending the time measurement in response to detecting the second signal; determining a time measurement value in response to ending the time measurement; determining a leveling speed of the elevator car by dividing the predetermined distance between the first sensor and the second sensor by the time measurement value; and adjusting the leveling time in response to determining the leveling speed.

Further according to the present invention, an apparatus for adjusting a leveling time of an elevator car, the apparatus comprising: an encoded medium disposed in an elevator hoistway; a first sensor for providing a first signal in response to sensing said encoded medium; a second sensor for providing a second signal in response to sensing said encoded medium, said second sensor being disposed a predetermined distance from said first sensor; a timer for determining a time between the first signal and the second signal; a processor for determining a leveling speed of the elevator by dividing the predetermined distance between the first sensor and the second sensor by the time between the first signal and the second signal, wherein the leveling time is adjusted in response to the leveling speed.

BEST MODE FOR CARRYING OUT THE INVENTION

Figure 1:
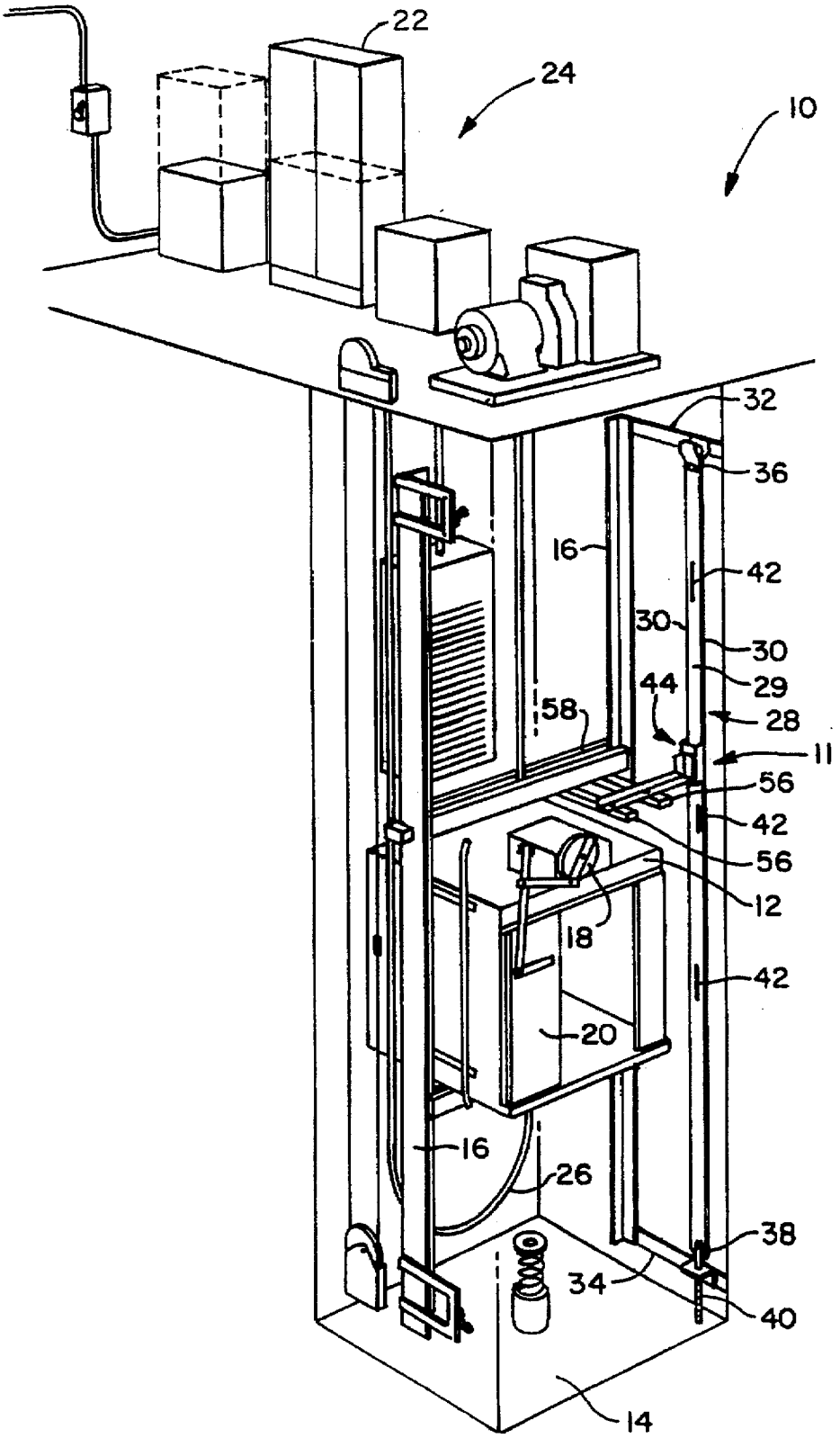
FIG. 1 is a perspective view of a elevator system incorporating a preferred embodiment of the present invention.

Referring to FIG. 1, an elevator system 10 is shown. An elevator car 12 is disposed in a hoistway 14 such that the elevator car 12 may travel along elevator guide rails 16 disposed vertically in the hoistway 14. A door operator 18 is disposed on the elevator car 12 so that the door operator 18 may open and dose the elevator door(s) 20 as needed. An elevator controller 22 is disposed in a machine room 24 which monitors and provides system control of the elevator system 10. A traveling cable 26 is used to provide an electrical connection between the elevator controller 22 and electrical equipment in the hoistway 14. Of course, it should be realized that the present invention can be used in conjunction with other elevator systems including hydraulic and linear motor systems, among others.

Figure 2:
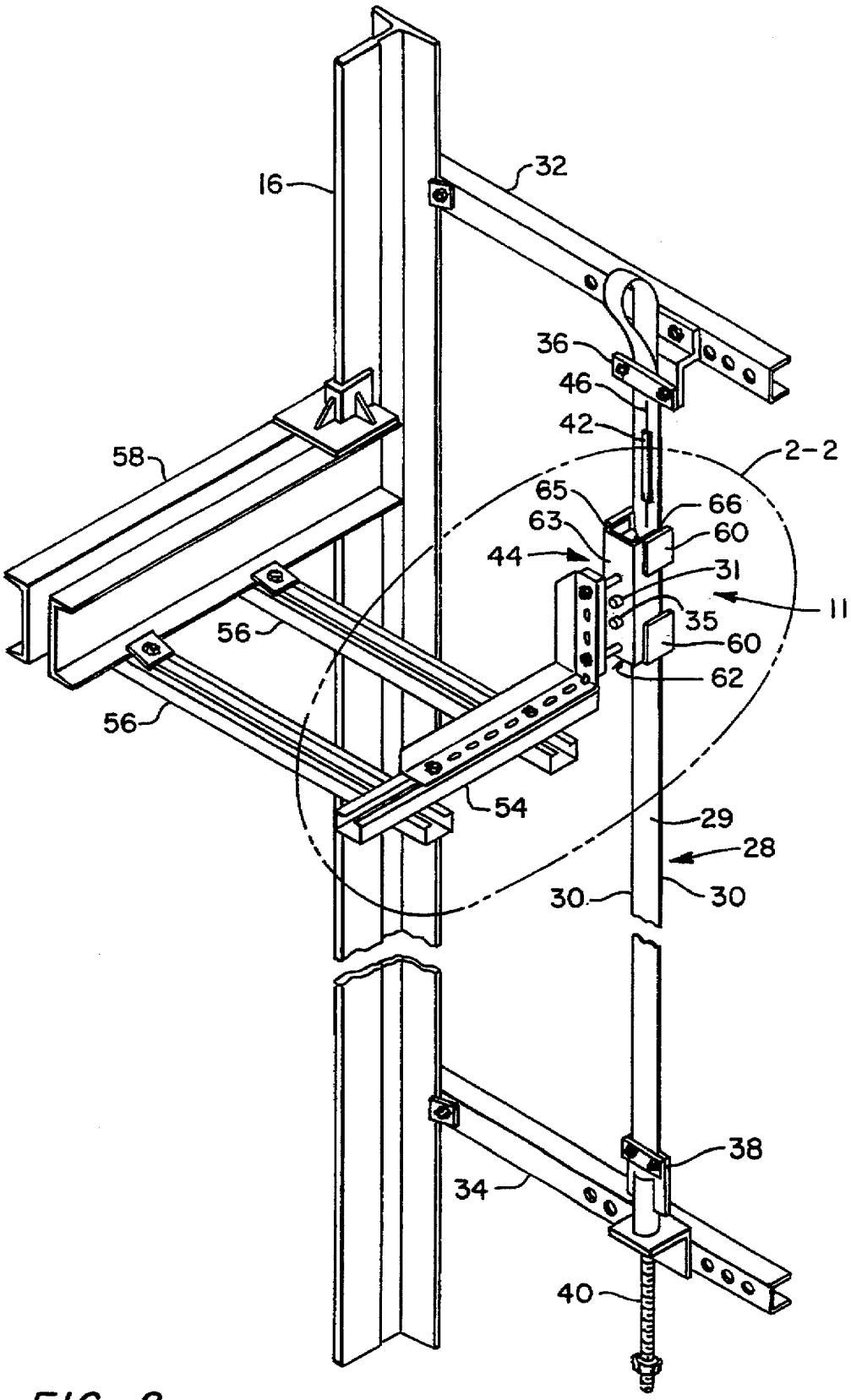
FIG. 2 is a perspective view of a floating tape system.
Figure 3:
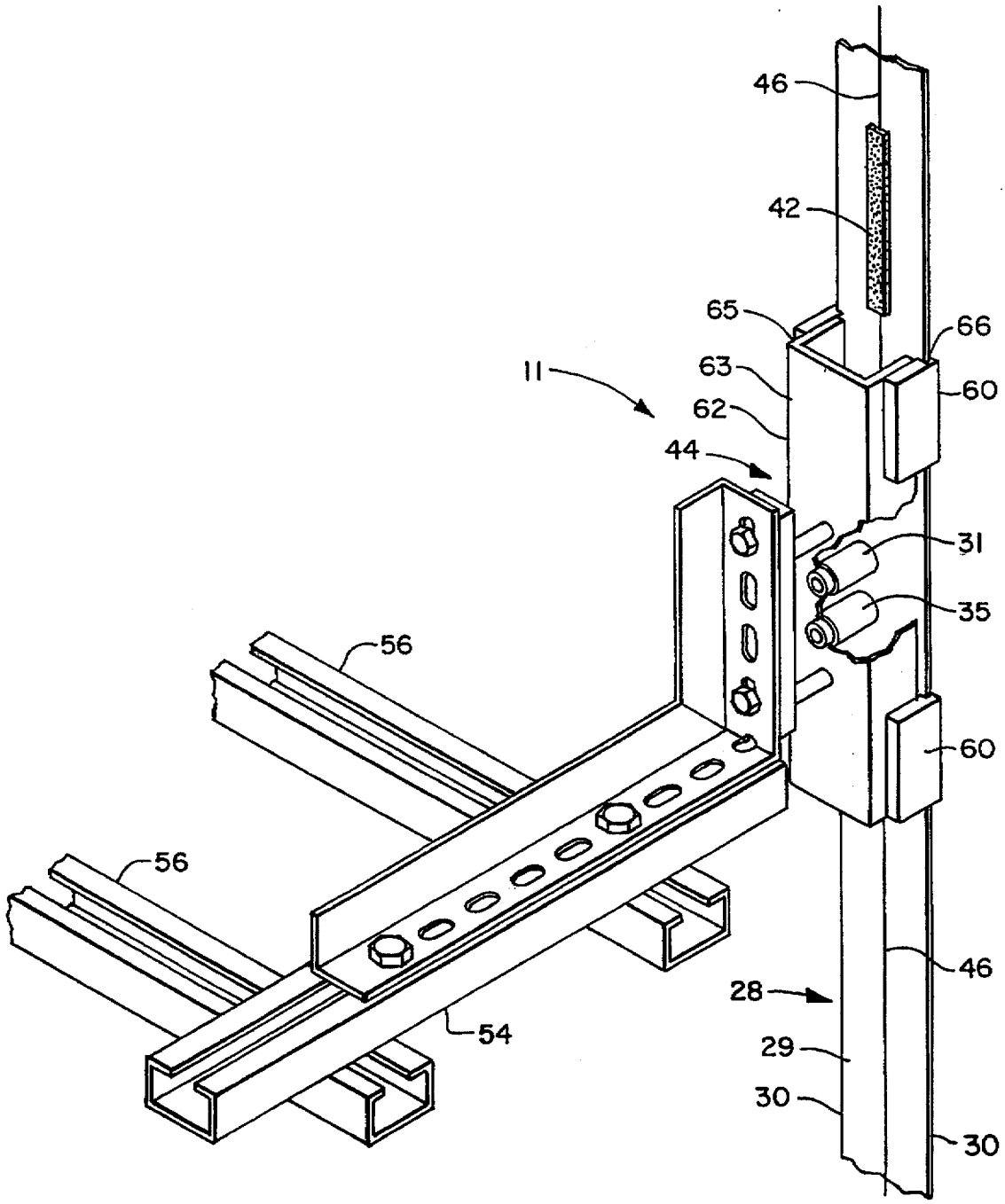
FIG. 3 is a magnified view of the floating tape system taken along 2—2 of FIG. 2.

Referring to FIGS. 2, 3, an elevator position apparatus 11 is used in conjunction with the elevator system 10 to accurately determine the position of the elevator car 12 within the hoistway 14. In addition, according to the present invention, the elevator position apparatus 11 is used to provide information to the elevator controller 22 such that the elevator controller 22 can properly adjust the speed of the elevator car 12 as is described hereinbelow. In a preferred embodiment, the elevator position apparatus 11 includes an encoded medium 28, sensor modules 31, 35 and a reader 44.

An embodiment of the encoded medium 28 is shown that includes a steel tape 29, having outer edges 30, disposed vertically in the hoistway 14. The steel tape 29 is attached to upper and lower horizontal supports 32, 34 by upper and lower tape hitches 36, 38 respectively. The upper and lower supports 32, 34 provide vertical support to the steel tape 29 and are attached to the guide rails 16. Additionally, a spring 40 is used in conjunction with the lower hitch 38 for providing tension in the steel tape 29. It should be understood by one skilled in the art that other suitable encoded mediums can be used without departing from the spirit and scope of the present invention.

The encoded medium 28 may be encoded using various methods. For example, optical or mechanical encoding methods can be used. In one embodiment, the encoded medium 28 is encoded by disposing magnets 42 on the steel tape 29 in predetermined positions. For example, magnets 42 are located on the steel tape 29 with respect to their corresponding hoistway landings (not shown) to mark the appropriate door zone. In a preferred embodiment, the steel tape 29 includes one to three discrete vertical planes ("traces") 46 for placing magnets 42. Each magnet 42 is positioned along one of the traces 46 in the steel tape 29. Various changes to the above description of the length and position of the magnets may be made without departing from the spirit and scope of the present invention as would be obvious to one of ordinary skill in the art.

Figure 4:
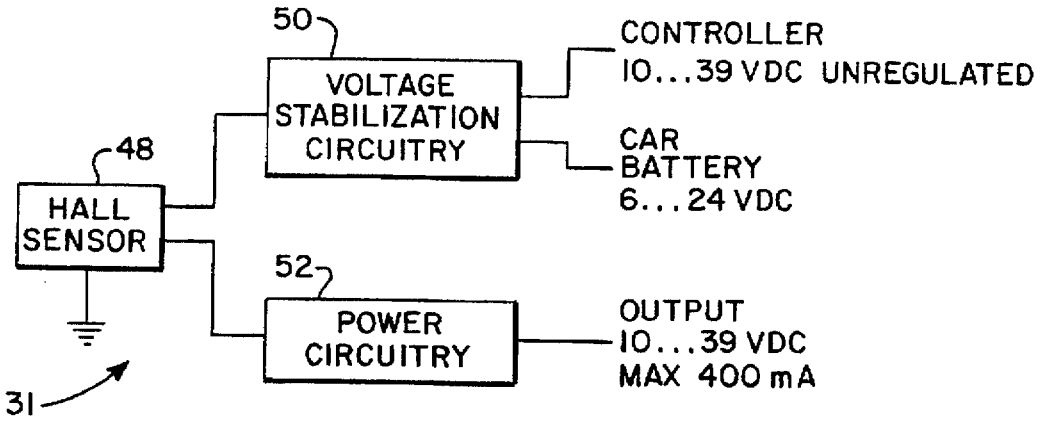
FIG. 4 is a block diagram of a preferred embodiment of a sensor module.
Figure 5:
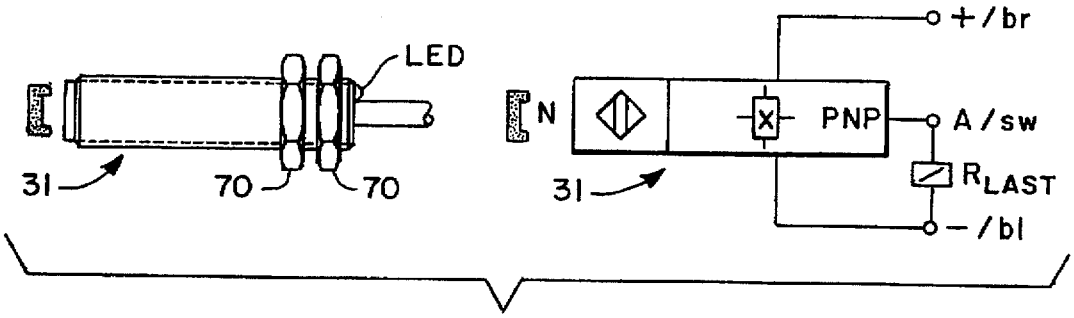
FIG. 5 is a schematic diagram of a preferred embodiment of the sensor module.

Referring to FIGS. 4, 5, sensors modules 31, 35 are used to detect the encoding embodied in the encoded medium 28. In a preferred embodiment, the sensors modules 31, 35 are hall effect devices which produce electrical sensor signals when placed in close proximity to the magnets 42. Each sensor module 31, 35 includes a hall sensor 48, voltage stabilization circuitry 50 and power circuitry 52. The hall sensor 48 provides a sensor signal in response to sensing the magnets 42. The voltage stabilization circuitry 50 stabilizes an unregulated voltage provided by either the controller 22 or a battery (not shown) and provides the stabilized voltage to the hall sensor 48. The power circuitry 52 provides amplification to the sensor signal so that the sensor signal can activate a relay or a lamp located in the controller 22 or the machine room 24. Thus, the sensor signal can be directly transmitted from the sensor module 31, 35 to the machine room 24 without further modification. Suitable designs for the voltage stabilization circuitry 50 and the power circuitry 52 are known to those skilled in the art. Although the above description illustrates one embodiment of the level sensors of the present invention, other commercially available sensors may be used without departing from the spirit and scope of the present invention. For example, a magnet switch or an inductive transducer may be used as a sensor by the present invention.

The reader 44, as shown in FIGS. 2, 3, is attached to an angle bracket 54 which is attached to mounting channels 56 which in turn are attached to the crosshead 58 of the elevator car 12. As a result, the reader 44 moves with the elevator car 12 as the elevator car 12 moves up and down the hoistway 14. The reader 44 moves the sensor modules 31, 35 along the encoded medium 28 as the elevator car 12 travels in the hoistway 14.

Figure 6:
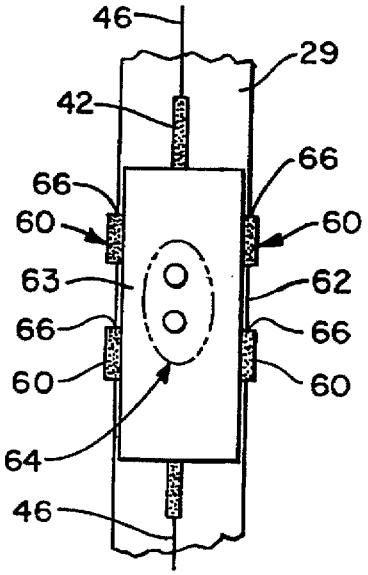
FIG. 6 is a front view of a preferred embodiment of a reader.
Figure 7:
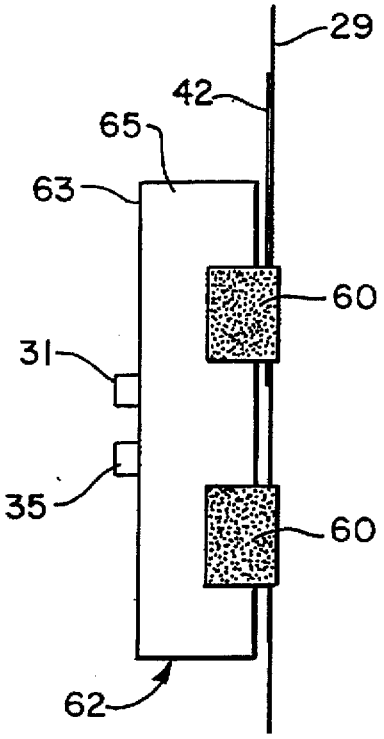
FIG. 7 is a side view of a preferred embodiment of the reader.
Figure 8:
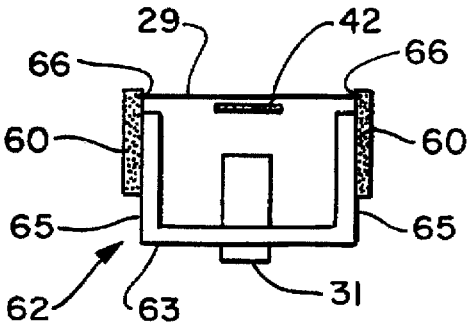
FIG. 8 is a top view of a preferred embodiment of the reader.

Referring to FIGS. 6, 7, 8, the reader 44 includes guides 60 and a channel 62 having a mounting plate 63 and two supports 65 extending at ninety degrees from the mounting plate 63. The mounting plate 63 having a group of apertures 64 for receiving the sensor modules 31, 35. In a preferred embodiment, four guides 60 are attached to the channel 62 for facilitating movement of the reader 44 along the encoded medium 28. Each guide 60 has a longitudinal groove 66 defining an area formed therein such that the groove 66 is adapted to receive and retain the outer edges 30 of the steel tape 29. As the elevator car 12 travels in a direction in the hoistway 14, the reader 44 travels in the same direction with the outer edges 30 of the steel tape 29 traversing through the grooves 66 formed in the guides 60. Thus, a constant distance between the sensor modules 31, 35 and the steel tape 29 is maintained as the reader 44 travels in the hoistway 14.

The group of apertures 64 is configured for receiving the sensor modules 31, 35. The sensor modules 31, 35 are disposed in the apertures such that the sensor modules 31, 35 face the steel tape 29 and are affixed to the channel 62 in a conventional manner by use of a known fastening means such as a threaded nut 70. The sensor modules 31, 35 are disposed in the same trace 46 as their corresponding magnet 42 so that the sensor modules 31, 35 detect the location of their corresponding magnet 42 as the elevator car 12 and the reader 44 travels in the hoistway 14. Accordingly, the sensor modules 31, 35 are disposed a predetermined distance $d_L$ from each other. In one embodiment, the predetermined distance $d_L$ between the sensor modules 31, 35 is 3 cm.

The first sensor module (31 or 35) to sense the magnet is defined as a first leveling sensor and produces a first leveling signal 1LV. Similarly, the second sensor (31 or 35) module to sense the magnet is defined as a second leveling sensor and produces a second leveling signal 2LV. These leveling signals 1LV, 2LV, in one embodiment, are transmitted to the controller via the traveling cable. However, the signals may be transmitted by a variety of methods without departing from the spirit and scope of the present invention. The present invention utilizes the leveling signals 1LV, 2LV, in determining a leveling speed $v_L$ as is described hereinbelow.

Figure 9:
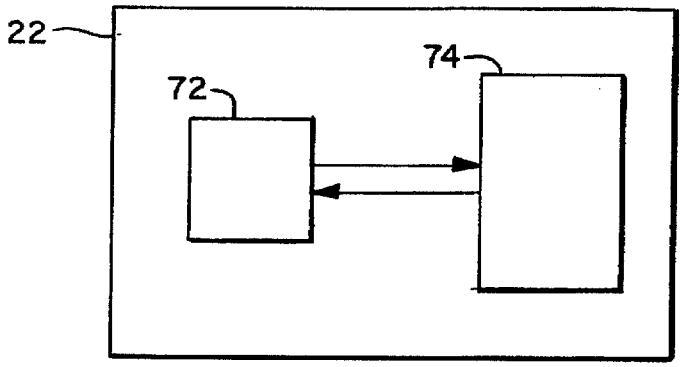
FIG. 9 is a block diagrams of an elevator controller.

Referring to FIG. 9, the elevator controller 22 includes a processor 72, and a memory 74. In one embodiment, the processor is a commercially available microcontroller such as an Intel 80C196. In one embodiment, the memory 74 is a commercially available memory such as a NEC μPD43256AGU-85L (32K*8 bit static CMOS RAM). The processor 72 executes commands which are stored in the memory 74. One such set of commands enables the controller 22 to adjust a leveling time of the elevator car 12 as is described below.

Figure 10:
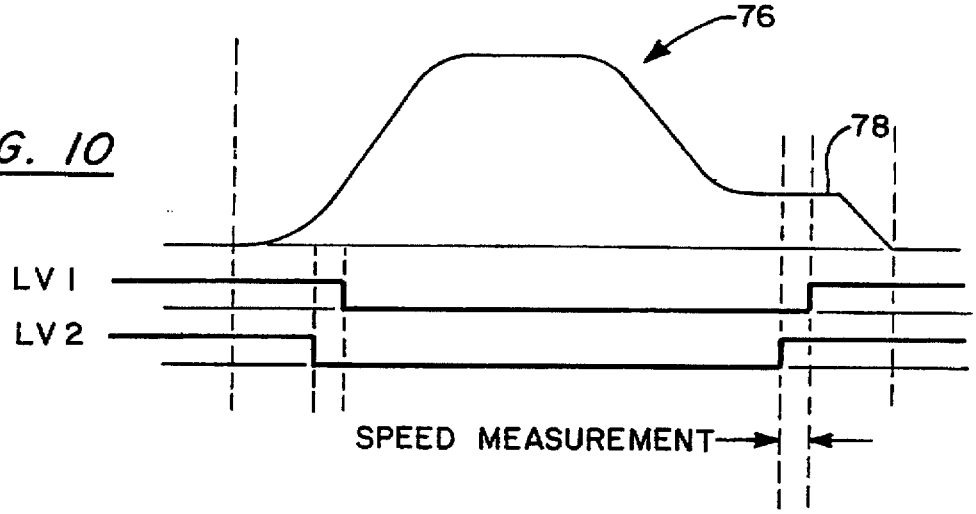
FIG. 10 is a timing diagram comparing a velocity profile of an elevator car with leveling signals.
Figure 11:
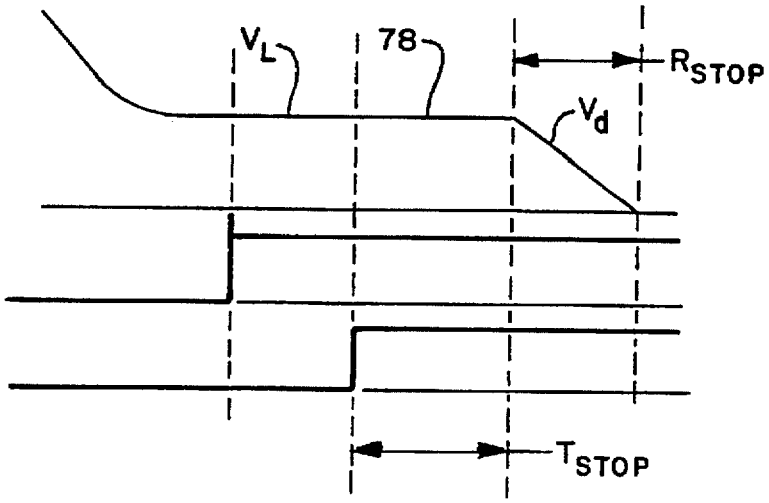
FIG. 11 is a timing diagram comparing a velocity profile of an elevator car with leveling signals at a leveling zone.

Referring to FIGS. 10, 11, a timing diagram comparing a velocity profile 76 of an elevator car 12 with the leveling signals 1LV, 2LV is shown. The latter portion of the velocity profile is known as a leveling zone 78. The leveling zone portion 78 of the velocity profile 76 includes the leveling time $T_{stop}$ and a deceleration time $R_{stop}$. The leveling time $T_{stop}$ begins as the second leveling sensor senses the magnet and ends at a determined time. The leveling time $T_{stop}$ is variable and is adjusted in response to a leveling speed $v_L$ of the elevator as is described below. The deceleration time $R_{stop}$ begins at the determined time and ends as the elevator car stops at the desired landing. The deceleration time $R_{stop}$ is not varied. In one embodiment, the deceleration time $R_{stop}$ is set to 500 ms.

The speed of the elevator car in the leveling segment $T_{stop}$ is defined as the leveling speed $v_L$. The leveling speed $v_L$ must be high enough so that the elevator car 12 does not come to a halt prior to reaching the landing. For example, the leveling speed $v_L$ must be high enough to overcome the friction caused by various devices in the elevator system 10 such as a gear box (not shown) and the hoistway 14. If the leveling speed $v_L$ is too low, the elevator car 12 lacks the momentum to overcome the friction and it slowly comes to a halt outside the door zone. Conversely, the leveling speed $v_L$ must be low enough so that the elevator car 12 has a smooth deceleration during the deceleration time $R_{stop}$ when reaching the final stopping point. If the leveling speed $v_L$ is too high, the deceleration during the deceleration time $R_{stop}$ may be too sudden and may cause ride comfort problems. In one embodiment, the dictated leveling speed is set to 10 cm/s.

The speed of the elevator car during the deceleration time $R_{stop}$ is the deceleration speed $v_d$. The deceleration speed $v_d$ is obtained by determining the proper reduction in the speed of the elevator car between the leveling speed $v_L$ and zero within the deceleration time $R_{stop}$. In one embodiment, the leveling speed $v_L$ is divided by the deceleration time $R_{stop}$ to obtain a deceleration step value. Then, the deceleration step value is recursively subtracted from the elevator speed every given time period, for example, every 10 ms, until the deceleration speed $v_d$ reaches zero at which point the elevator car 12 stops.

Variations in certain elevator parameters, such as load, can cause a variation in the leveling speed $v_L$. In order for the elevator car to accurately land at the desired landing, the elevator system 10 must be able to adjust for variances in the leveling speed $v_L$; otherwise, the elevator car 12 may overshoot or undershoot the landing. If the elevator system 10 has a speed encoder, these speed variations can be detected by the speed encoder and corrected. However, if an encoderless system is used then the leveling speed $v_L$ must be determined by an alternative method and accurate landing achieved using an alternative adjustment method. The present invention utilizes the leveling sensors 31, 35 to determine the leveling speed $v_L$ so that the leveling time $T_{stop}$ may be adjusted in response to any deviations in the leveling speed $v_L$ as is described below.

The leveling speed $v_L$ of the elevator car 12 is determined by using the formula: speed=distance/time. As stated above, the predetermined distance $d_L$ between the sensors is known. The time between the activation of the first leveling sensor and the second leveling sensor is calculated by a timer built into the processor 72. When the first leveling sensor is activated, in response to sensing the magnet 42, the first leveling sensor generates the first leveling signal 1LV. The first leveling signal 1LV is used as an interrupt signal such that it causes a time measurement to be initiated and a value of the timer to be stored in the memory 74. When the second leveling sensor is activated, in response to detecting the magnet 42, the second leveling signal is generated which is also used as an interrupt signal. The second leveling signal ends the time measurement and a value of the timer is again stored in the memory 74. The difference between these two timer values multiplied by a constant is a time measurement value $t_M$, i.e., the time required to cross the predetermined distance $d_L$ between the first and second leveling sensors for the actual leveling speed $v_L$. The constant, in one embodiment, is 1.6 μs per timer count, i.e., the timer is incremented every 1.6 μs by the processor 72 so that if we count 1000 counts then the elapsed time is 1.6 ms. The counter is automatically incremented by the processor 72 and no software is required. Alternatively, the timer may be implemented, for example, in software as would be understood by one skilled in the art in light of the present specification. Finally, the actual leveling speed $v_L$ of the elevator is determined by the processor 72 by dividing the predetermined distance $d_L$ by the time measurement value $t_M$. For example, if the predetermined distance $d_L$ is 3 cm and the time measurement value $t_M$ is 310 ms then the actual leveling speed $v_L$ is 9.8 cm/s.

Figure 12:
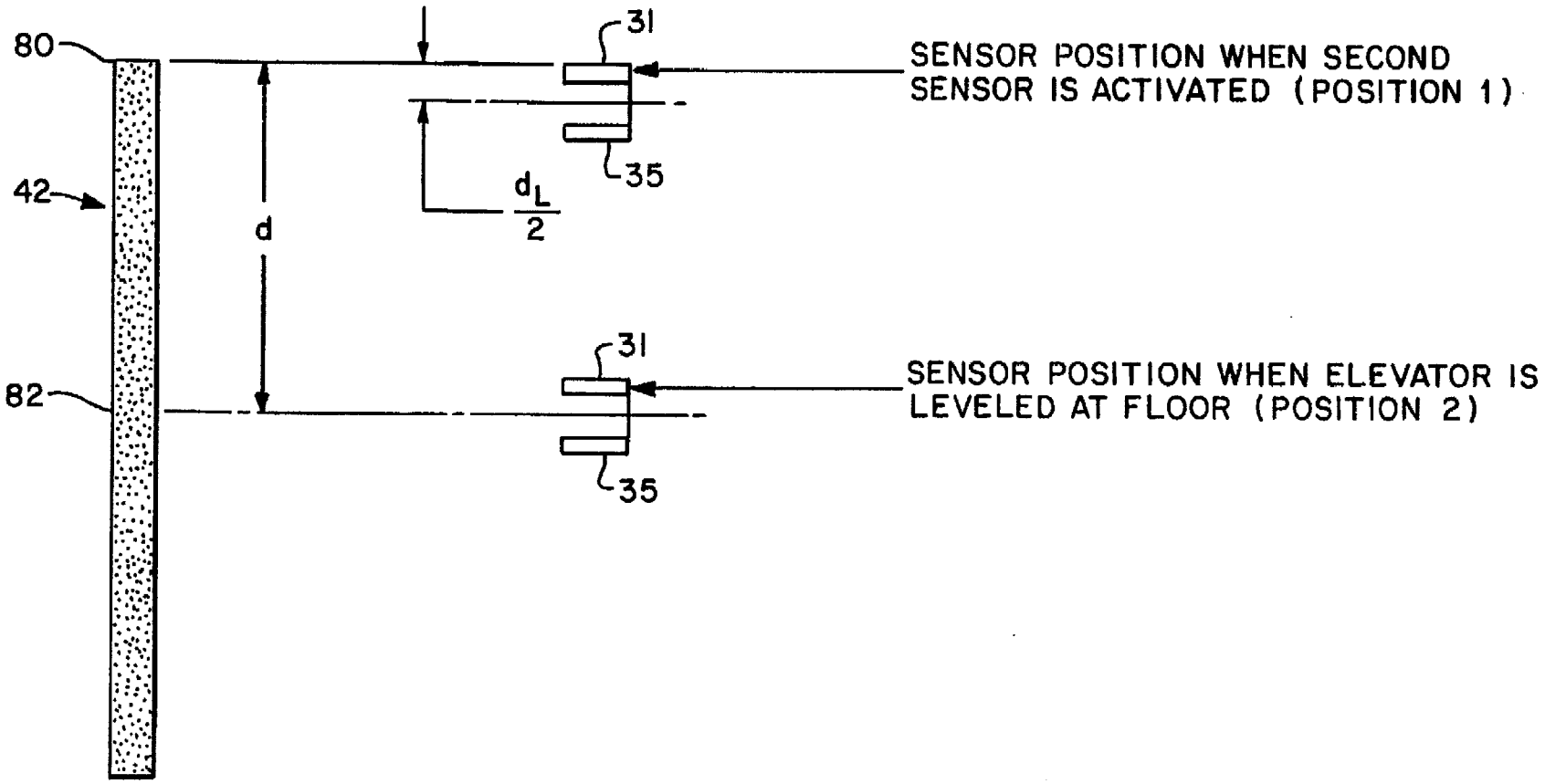
FIG. 12 is a block diagram showing leveling sensors in first and second positions.

Referring to FIG. 12, the leveling time $T_{stop}$ is adjusted in response to the actual leveling speed $v_L$ as is explained hereinbelow. When the leveling sensors 31, 35 are in position 1, the leveling speed $v_L$ already has been determined as described above. The predetermined distance $d_L$ between the two leveling sensors 31, 35 is known. The distance d between the end of the magnet 80 and the leveling point 82 is known. The deceleration time $R_{stop}$ also is known. From this information, the adjusted level time $T_{stop}$ is determined as follows. The distance to travel so that the midpoint between the leveling sensors 31, 35 is at the leveling point is $d-d_L/2$. By definition, the elevator is leveled when the midpoint between the leveling sensors 31, 35 is at the leveling point 82. The distance $d_{RD}$ that the elevator travels during the deceleration time $R_{stop}$ is determined by the equation $d_{RD}=v_L*R_{stop}*0.5$. The total distance $d_{LEFT}$ that the elevator must travel at the current speed before beginning deceleration is determined by the equation $d_{LEFT}=d-d_L/2-d_{RD}$. Therefore, the time required to travel the distance $d_{LEFT}$, i.e., the leveling time $T_{stop}$, is determined by $T_{stop}=d_{LEFT}/v_L$.

The leveling time $T_{stop}$ is loaded into a second timer in the processor 72 such that the second timer begins a count down. The second timer generates an interrupt signal when it completes the count down. When the interrupt is generated, the deceleration time $R_{stop}$ begins and the elevator car 12 decelerates until it stops leveled at the landing. Thus, the leveling time $T_{stop}$ is adjusted to compensate for variances in the leveling speed $v_L$. Of course, one skilled in the art should realize that the second timer can be implemented in a number of embodiments. For example, the second timer can be implemented in software.

The present invention provides accurate leveling without requiring a speed encoder. Thus, costs and complexity introduced by speed encoders are eliminated by the present invention. Additionally, the costs of modernizing a large variety of elevator systems is reduced because the present invention, as opposed to using a speed encoder, does not need to be configured to a specific motor design.

Various changes to the above description may be made without departing from the spirit and scope of the present invention as would be obvious to one of ordinary skill in the art of the present invention.

What is claimed is:

1. A method of adjusting a leveling time of an elevator car, said method comprising the steps of:

moving the elevator car in a hoistway;

transmitting a first signal by a first sensor in response to moving the elevator car in the hoistway;

beginning a time measurement in response to detecting the first signal;

transmitting a second signal by a second sensor in response to moving the elevator car in the hoistway, the second sensor being disposed a predetermined distance from the first sensor;

ending the time measurement in response to detecting the second signal;

determining a time measurement value in response to ending the time measurement;

determining a leveling speed of the elevator car by dividing the predetermined distance between the first sensor and the second sensor by the time measurement value; and adjusting the leveling time in response to determining the leveling speed.

2. A method of adjusting a leveling time of an elevator car as recited in claim 1, wherein said adjusting step comprises the step of determining a distance that the elevator car must travel at the leveling speed before beginning a deceleration.

3. A method of adjusting a leveling time of an elevator car as recited in claim 2, wherein said adjusting step further comprises the step of determining the leveling time by dividing the distance that the elevator car must travel at the leveling speed before beginning deceleration by the leveling speed.

4. A method of adjusting a leveling time of an elevator car as recited in claim 1 wherein the first and second sensors are leveling sensors.

5. A method of adjusting a leveling time of an elevator car, said method comprising the steps of:

moving the elevator car in a hoistway;

detecting a magnet by a first sensor in response to moving the elevator car in the hoistway;

beginning a time measurement in response to detecting the magnet;

detecting the magnet by a second sensor in response to moving the elevator car in the hoistway, the second sensor being disposed a predetermined distance from the first sensor;

ending the time measurement in response to detecting the magnet by the second sensor;

determining a time measurement value in response to ending the time measurement;

determining a leveling speed of the elevator by dividing the predetermined distance between the first sensor and the second sensor by the time measurement value; and adjusting the leveling time in response to determining the leveling speed.

6. A method of adjusting a leveling time of an elevator car as recited in claim 5, wherein said adjusting step comprises the step of determining a distance that the elevator car must travel at the leveling speed before beginning a deceleration.

7. A method of adjusting a leveling time of an elevator car as recited in claim 6, wherein said adjusting step further comprises the step of determining the leveling time by dividing the distance that the elevator car must travel at the leveling speed before beginning deceleration by the leveling speed.

8. A method of adjusting a leveling time of an elevator car as recited in claim 5 wherein the first and second sensors are leveling sensors.

9. An apparatus for adjusting a leveling time of an elevator car, said apparatus comprising:

an encoded medium disposed in an elevator hoistway;

a first sensor for providing a first signal in response to sensing said encoded medium;

a second sensor for providing a second signal in response to sensing said encoded medium, said second sensor being disposed a predetermined distance from said first sensor;

a timer for determining a time between the first signal and the second signal;

a processor for determining a leveling speed of the elevator by dividing the predetermined distance between the first sensor and the second sensor by the time between the first signal and the second signal, wherein the leveling time is adjusted in response to the leveling speed.

10. An apparatus for adjusting a leveling time of an elevator car as recited in claim 9, wherein said processor determines a distance that the elevator car must travel at the leveling speed before beginning a deceleration.

11. An apparatus for adjusting a leveling time of an elevator car as recited in claim 10, wherein said processor determines the leveling time by dividing the distance that the elevator car must travel at the leveling speed before beginning deceleration by the leveling speed.

12. An apparatus for adjusting a leveling time of an elevator car as recited in claim 9, wherein said first and second sensors are leveling sensors.

13. An apparatus for adjusting a leveling time of an elevator car as recited in claim 9, wherein said encoded medium comprises a steel tape disposed vertically in the elevator hoistway.

14. An apparatus for adjusting a leveling time of an elevator car as recited in claim 9, wherein said encoded medium comprises a magnet.

* * * * *